United States Patent [19]

Lee

[11] 3,957,460

[45] May 18, 1976

[54] OXIDATION OF COAL-WATER SLURRY FEED TO HYDROGASIFIER

[75] Inventor: Bernard S. Lee, Lincolnwood, Ill.

[73] Assignee: The United States of America as represented by the United States Energy Research and Development Administration, Washington, D.C.

[22] Filed: Sept. 9, 1975

[21] Appl. No.: 611,780

[52] U.S. Cl. ..... 48/197 R; 48/202; 48/206; 48/210; 48/DIG. 7; 201/9; 201/31; 260/449 M

[51] Int. Cl.[2] ..... C10J 1/16; C01B 2/14

[58] Field of Search ..... 48/202, 206, 210, 197 R, 48/DIG. 7; 201/9, 31; 260/449 M; 431/11

[56] References Cited

UNITED STATES PATENTS

| | | | |
|---|---|---|---|
| 2,838,388 | 6/1958 | Carkeek et al. | 48/DIG. 7 |
| 2,864,677 | 12/1958 | Eastman et al. | 48/197 R |
| 2,942,959 | 6/1960 | Rees et al. | 48/197 R |

*Primary Examiner*—S. Leon Bashore
*Assistant Examiner*—George C. Yeung
*Attorney, Agent, or Firm*—Dean E. Carlson; Arthur A. Churm

[57] ABSTRACT

An aqueous coal slurry is preheated, subjected to partial oxidation and vaporization by injection of high pressure oxygen and is introduced into a top section of a hydrogasifier in direct contact with hot methane-containing effluent gases where vaporization of the slurry is completed. The resulting solids are reacted in the hydrogasifier and the combined gases and vapors are withdrawn and subjected to purification and methanation to provide pipeline gas. The amount of oxygen injected into the slurry is controlled to provide the proper thermal balance whereby all of the water in the slurry can be evaporated in contact with the hot effluent gases from the hydrogasifier.

7 Claims, 1 Drawing Figure

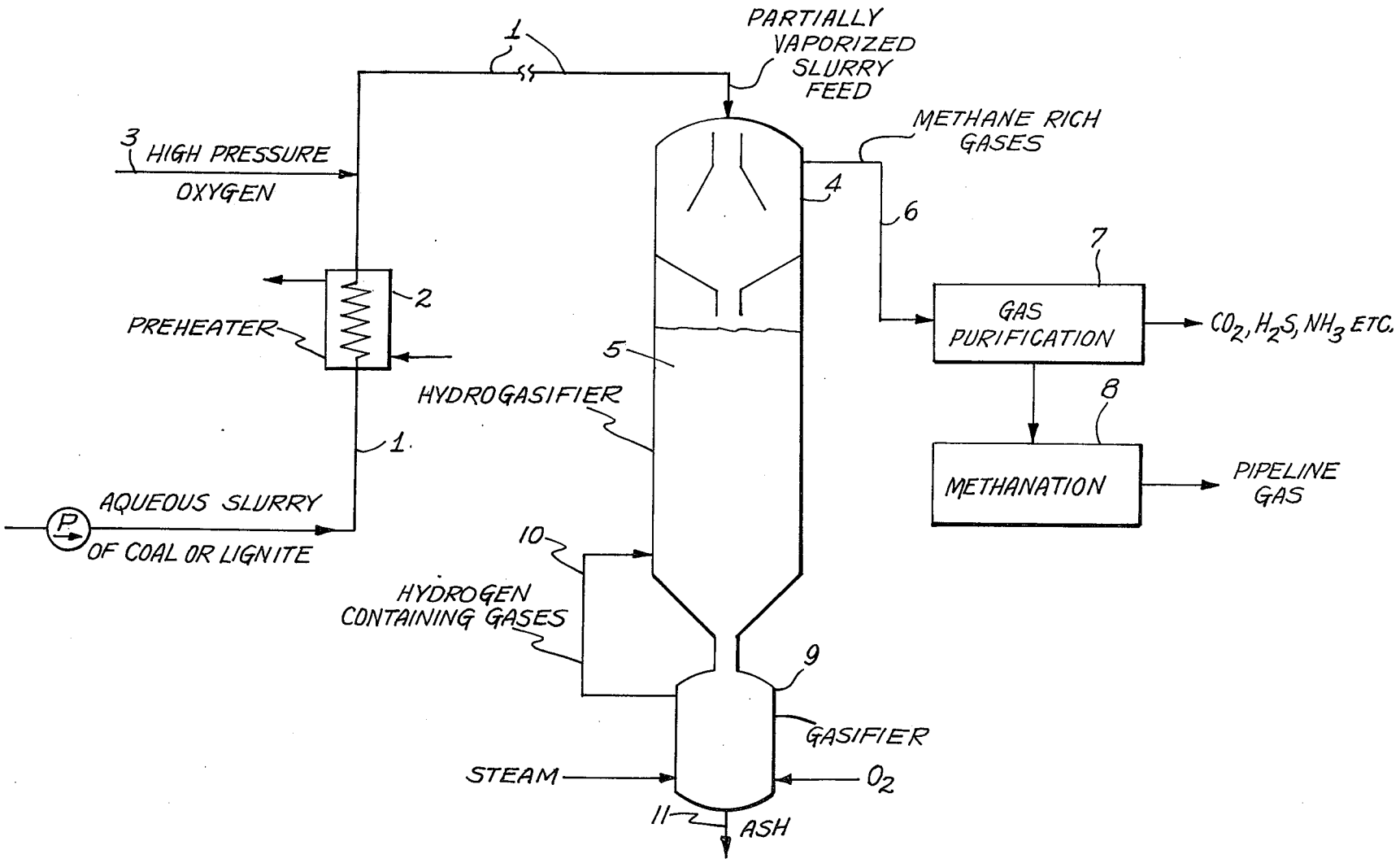
$CO_2$, $H_2S$, $NH_3$ ETC.
PIPELINE GAS
7
8
GAS PURIFICATION
METHANATION
METHANE RICH GASES
6
PARTIALLY VAPORIZED SLURRY FEED
4
9
GASIFIER
$O_2$
ASH
11
5
HYDROGASIFIER
10
HYDROGEN CONTAINING GASES
STEAM
1
2
1
HIGH PRESSURE OXYGEN
3
PREHEATER
AQUEOUS SLURRY OF COAL OR LIGNITE
P

OXIDATION OF COAL-WATER SLURRY FEED TO HYDROGASIFIER

BACKGROUND OF THE INVENTION

1. Field of the Invention

This invention relates to an improved process for the manufacture of synthetic pipeline gas from carbonaceous fuel such as coal, lignite or the like. The importance of such a process has taken on new light in view of the energy crisis as pipeline gas has excellent heating value and may be used in the place of fuel oil. While there are known many processes for converting coal to pipeline gas, the need still exists for an economical and effective process.

2. Description of the Prior Art

One well known coal gasification process is the Institute of Gas Technology (IGT) HYGAS process which involves high pressure operations wherein hydrogen rich gases react with coal directly to form methane. While there are many coal gasification processes to which the present invention may be applied, it will be described in detail in connection with the IGT HYGAS process.

More particularly, in the HYGAS process, pulverized and pretreated bituminous coal is reacted at about 1200°–1750°F. and at a pressure of about 1000 to 1500 psig with hot, raw, hydrogen rich gas containing a substantial amount of steam. Before the coal is reacted, it is usually subjected to pretreatment since most bituminous coals tend to agglomerate and cake during hydrogasification. Such pretreatment usually consists of mild surface oxidation of the pulverized coal with air or oxygen in a fluidized bed reactor at about 800°F. and atmospheric pressure. Although under the conditions of pretreatment most of the valuable reactive portion, i.e., volatile matter, of the coal is preserved, the pretreatment step still generates a substantial volume of low heating value fuel gas (on the order of 50 Btu per std. cu. ft.) containing a relatively high content of sulfur in the form of $SO_2$. Some tar and light oil are also formed. The loss of valuable carbonaceous components of the coal in this step reduces the overall thermal efficiency of the process. Moreover, the cleaning and upgrading of the low value fuel gas requires additional apparatus which adds to the cost of the process, particularly if environmental safeguards are maintained with respect to the quality of the fuel gas.

It has been proposed to use water as a slurry medium to facilitate the feeding of coal to high pressure gasifiers. However, water has a high heat of vaporization and in most instances there is insufficient heat available in a hydrogasifier effluent to evaporate the water. This has necessitated the use of a recycle oil with a low latent heat as the slurry medium which in turn requires troublesome separation and recycle.

An improved process is disclosed in U.S. Pat. No. 3,632,479 of Bernard Lee et al., which patent is specifically incorporated by reference herein. This patent discloses a process for the pretreatment of a caking coal to prevent agglomeration wherein an aqueous slurry of the coal is treated with air or oxygen at a temperature of about 500° to 700°F. and a pressure of about 1,000 to 3,000 psig in a treating vessel ahead of the gasifier. Off-gases from the treating vessel have to be separately disposed of and no consideration is given to the thermal requirements for vaporizing the water from the slurry which is then fed to the gasifier.

SUMMARY OF THE INVENTION

The present invention provides an improved process for feeding solid carbonaceous materials, including caking and non-caking coals, lignite and the like, in the form of a water slurry to a hydrogasifier while avoiding the problems associated with the prior art processes discussed above.

It is an object of the invention to provide a preliminary oxidation of the carbonaceous material in the slurry and to utilize the heat generated during this pretreatment to help evaporate the water when the resultant slurry is introduced into the hydrogasification reactor.

Another object of the invention is the elimination of off-gases from the pretreatment stage by the direct introduction of all of the products of the pretreatment stage into the hydrogasifier under such conditions that the thermal balance is such that the heat contained in the feed slurry and in the hydrogasifier effluent gases is sufficient to evaporate all of the water in the slurry.

These objects are accomplished by preparing an aqueous slurry of the carbonaceous material in water, preheating this slurry to such temperature and pressure that oxidation with oxygen can take place within a reasonable contact time, introducing high pressure oxygen into the preheated slurry in a sufficient amount to oxidize the carbonaceous material to an extent necessary to supply the heat requirement which with the heat of the hydrogasifier effluent gases will evaporate all of the water, and introducing the resultant partially vaporized slurry into the hydrogasifier in direct contact with the hot gasifier effluent gases.

The surprising and beneficial result of this process is that there is no need for a separate pretreater with all of the accessory equipment, and the separate handling of large volumes of low-Btu gases from the pretreater is eliminated. The heat of pretreatment is utilized directly and the gaseous and liquid products of pretreatment become part of the gaseous and liquid product of gasification which can be processed through the usual equipment. Without slurry oxidation, water cannot be used because of the shortage of heat to evaporate the water. The concept of the present invention is to control the amount of slurry oxidation to provide this heat requirement.

BRIEF DESCRIPTION OF DRAWING

The invention will be further understood by reference to the accompanying drawing in which the sole FIGURE is a diagrammatic illustration of a representative embodiment of the process.

DETAILED DESCRIPTION

Referring now to the drawing, an aqueous slurry of coal, lignite or the like in line 1 is preheated by conventional means, such as by a heat exchanger 2. Various conventional techniques, such as that disclosed in U.S Pat. No. 2,987,387, may be used to form the slurry and the amount of water present may vary although the slurry formed must be flowable. Usually the coal is ground to less than ¼ inch average diameter and the slurry will contain about 45 to 60% water.

The preheating of the aqueous slurry is to facilitate subsequent oxidation in a reasonable contact time. This temperature may range from 400° to 700°F. and the slurry at this point is under a pressure of 300 psig or greater depending on the pressure in the hydrogasifier.

Oxygen under a higher pressure than exists in the slurry line 1 is injected through line 3 into the preheated slurry and oxidation occurs within the line 1. This pipeline is of such length as to ensure that there is sufficient contact time to achieve the desired degree of oxidation. The amount of oxygen introduced through line 3 is controlled to provide the necessary amount of oxidation to provide the heat requirement desired. It is contemplated that the amount of oxygen will be sufficient to burn about 0.1 to 10% of the coal, the exact amount depending on the other thermal considerations as will become apparent from the following description. A closed vessel (not shown) may be incorporated in line 1 if it is desired to shorten this line or provide greater contact time. The slurry, now in partially vaporized form, is introduced into a top section 4 of hydrogasifier 5 where it is directly contacted by hot effluent gases from the hydrogasification section. These gases are usually at a temperature above 1000°F. The water is completely evaporated in the top section 4 and passes with the methane rich gaseous effluent out through line 6 to gas purification plant 7. After purification the gases pass through methanator 8 for up-grading to pipeline quality. Final up-grading to pipeline quality in methanator 8 is accomplished by conventional means such as by passage of the gases over a fixed-bed catalyst after purification in plant 7 where carbon dioxide, liquid aromatics, sulfur, ammonia and the like impurities are removed.

In the embodiment shown, the carbonaceous solids after vaporization of the moisture in section 4 fall by gravity into the main section of hydrogasifier 5 where they are met with a hot hydrogen rich stream from gasifier 9. Char and ash fall from the hydrogasifier 5 into gasifier 9 and are contacted with oxygen and steam to generate hydrogen which flows through line 10 into the hydrogasifier. Ash is withdrawn through line 11.

Typically, the temperature and pressure in the gasifier 9 will be about 1850°F. and 1100 psig, respectively in the lower portion of the hydrogasifier 5 about 1750°F. and 1100 psig, respectively; and in the top section of the hydrogasifier about 1250°F. and 1100 psig respectively.

These temperatures and pressures can be varied as known in the art. The important consideration of the present invention is that the slurry introduced into the top section 4 of the hydrogasifier 5 contains sufficient heat from the preliminary oxidation in pipeline 1 to make up for any thermal deficiency in the effluent gases from the hydrogasification reaction.

EXAMPLE 1

A 50% slurry of coal and water consisting of 6000 lbs. of bituminous coal and 6000 lbs. of water per hour at a temperature of 60°F. is preheated to a temperature of 500°F. in heat exchanger 2. The temperature of the hot gasifier effluent in the hydrogasifier section 5 is found to be 1300°F. and the temperature of the gases leaving the section 4 through line 6 is to be 600°F.. It is determined that 9,048,000 Btu per hour are required to evaporate the water in the slurry and that 3,432,000 Btu per hour are supplied in preheater 2 and 1,662,000 Btu per hour are supplied from the hydrogasifier effluent gases. The remainder of the heat requirement of 3,954,000 Btu per hour is to be supplied by the oxidation reaction in line 1 using high pressure oxygen. Since the heating value of bituminous coal is about 12,000 Btu/lb. this requires the oxidation of about 329 pounds of coal during the preliminary treatment between preheater 2 and section 4. Since 6,000 pounds of coal are contained in the slurry the percentage of coal used in the pretreatment is 329/6000 or 5.5% which corresponds to 292 pounds of oxygen per ton of coal. This amount of oxygen or a slight excess thereof is injected through line 3.

By using the temperatures provided in this example the additional necessary heat to completely vaporize the slurry can be supplied by oxidizing 5.5% of the coal. It is to be appreciated that the necessary extent of the oxidization in each instance depends upon the temperature to which the slurry is preheated in preheater 2, the temperature of the effluent gases from the hydrogasifier and the heating value of the coal. These values can be readily determined by one skilled in the art thereby determining the amount of high pressure oxygen required to be added to the system.

EXAMPLE 2

Instead of using bituminous coal as in Example 1, lignite is used in a 50% aqueous slurry of 6000 pounds lignite coal to 6000 pounds water at a temperature of 60°F.. The slurry is preheated to 500°F.. In this instance the temperature of the effluent gases from the hydrogasifier is assumed to be 1600°F. and the gases leaving the vaporizer section 4 through line 6 will be 600°F.. In this instance, 9,048,000 Btu per hour are required to evaporate the water from the slurry. The heat in the hydrogasifier gases supplies 2,640,000 Btu per hour and the preheater 2 supplies 3,432,000 Btu per hour, leaving 2,976,000 Btu per hour to be supplied by the preliminary oxidation in pipe 1. The lignite has a heating value of 7500 Btu/lb.. Accordingly, 397 lbs. of lignite/hour must be burned. This amounts to 6.6% of the lignite supplied. Oxygen sufficient to consume this amount of lignite is supplied through pipe 3.

It will be understood that if a slurry is used which contains less water, e.g. 55% solids and 45% water, lesser amounts of oxygen need be supplied for the pretreatment. Likewise, different degrees of preheat and different volumes and temperatures of effluent gases will require adjustments in amounts of oxygen as will be apparent to those skilled in the art.

The invention is useful on agglomerating or caking coals even without the heat balance consideration in that oxygen pretreatment as disclosed solves the agglomerating problem without generation of low Btu impure gases which must be separately treated. The oxygen required for making up the heat balance is well in excess of that required for preventing agglomeration. On these coals the invention therefore serves a dual function.

What is claimed:

1. A process for feeding carbonaceous solids to a hydrogasification reactor in which hot, methane-containing effluent gases are produced, comprising: forming an aqueous slurry of said carbonaceous solids, preheating said slurry under a pressure of at least about 300 pounds per square inch to a temperature in the range of about 400° to 700°F., introducing high pressure oxygen into said preheated slurry to partially oxidize said carbonaceous solids and thereby further heat and partially vaporize said slurry, introducing said partially vaporized slurry into direct contact with said hot, methane-containing effluent gases so as to completely evaporate the remaining unvaporized water portion of the slurry, withdrawing the combined gases and vapors from said reactor and introducing the solids from the completely vaporized slurry into a hydrogenation zone of the hydrogasification reactor, the amount of oxygen introduced into said slurry being controlled to oxidize sufficient carbonaceous material of the slurry to make up the heat requirement for total evaporation of the water in the slurry in contact with the hot methane-rich effluent gases.

2. The process of claim 1 wherein the carbonaceous solids are caking bituminous coal, so that the oxidation in slurry also renders the coal non-agglomerating.

3. The process of claim 1 wherein the carbonaceous solids are non-caking lignite, or subbituminous coal.

4. The process of claim 1 wherein the slurry is preheated to approximately 500°F., the hot methane-containing gases from the hydrogasification reactor are at a temperature of about 1000° to 1700°F. and the temperature of combined gases and vapors is approximately 600°F..

5. The process of claim 1 wherein the partially vaporized slurry is introduced into a top section of the hydrogasification reactor and contacted with the hot methane-containing effluent gases in said top section, the solids are dropped into a lower reaction zone of said reactor and the combined gases and vapors are withdrawn from said top section.

6. The process of claim 1 wherein the combined gases and vapors are purified and subjected to methanation to provide pipeline gas.

7. The process of claim 1 wherein the oxygen is introduced into a pipeline which conveys the slurry from the preheater to the hydrogasification reactor, and the length of the pipeline between these units is sufficient to provide the necessary contact time for sufficient oxidation of the carbonaceous solids to make up the heat requirement.

* * * * *